United States Patent [19]

Fischer et al.

[11] Patent Number: 4,636,265

[45] Date of Patent: Jan. 13, 1987

[54] AUTODEPOSITION POST-BATH RINSE

[75] Inventors: Herbert Fischer, Duesseldorf; Karl H. Stritzke, Langenfeld; Roland Morlock, Bergheim, all of Fed. Rep. of Germany; Thomas C. Jones, Melrose Park; Joseph C. Donovan, Drexel Hill, both of Pa.

[73] Assignee: Henkel Kommanditgesellschaft auf Aktien, Duesseldorf, Fed. Rep. of Germany

[21] Appl. No.: 802,643

[22] Filed: Nov. 26, 1985

[30] Foreign Application Priority Data

Nov. 26, 1984 [DE] Fed. Rep. of Germany ..... 3442985

[51] Int. Cl.[4] ..... C23F 7/00; B05D 7/16; B05D 3/10

[52] U.S. Cl. ..... 148/6.15 R; 148/6.15 Z; 148/6.2; 427/435

[58] Field of Search ..... 148/6.15 R, 6.2, 31.5; 427/435

[56] References Cited

U.S. PATENT DOCUMENTS

| | | | |
|---|---|---|---|
| 3,647,567 | 3/1972 | Schweri | 148/6.15 |
| 3,791,431 | 2/1974 | Steinbrecher et al. | 148/6.2 |
| 4,030,945 | 6/1977 | Hall et al. | 148/6.2 |
| 4,186,219 | 1/1980 | Hall | 427/8 |
| 4,186,226 | 1/1890 | Smith | 427/340 |
| 4,414,350 | 11/1983 | Hall | 524/320 |

*Primary Examiner*—Sam Silverberg

*Attorney, Agent, or Firm*—Ernest G. Szoke; Henry E. Millson, Jr.; Mark A. Greenfield

[57] ABSTRACT

A method of improving the anticorrosion properties of an autodeposited resin coating by including in the post-bath rinse (a) a metal dichromate, (b) a metal hypophosphite, or (c) a combination of either of the foregoing with a metal hydrogenphosphate, followed by curing.

18 Claims, No Drawings

AUTODEPOSITION POST-BATH RINSE

BACKGROUND OF THE INVENTION

1. Field of the Invention

This invention relates to improving the anticorrosive properties of an autodeposition coating by a post-bath rinse which introduces certain metal salts into the resin coating.

2. Statement of the Related Art

Inorganic pigments (i.e. insoluble colored substances) are capable of improving the anticorrosive properties of coatings which have been autodeposited on metal substrates. This is known from various publications. U.S. Pat. No. 4,030,945 discloses a process wherein metal surfaces, after they are autodeposition coated with organic resins, are rinsed with diluted aqueous solutions containing hexavalent chromium or combinations of hexavalent chromium with formaldehyde-reduced chromium compounds. In accordance with the disclosed process chromium compounds such as chromium trioxide (chromic acid), and/or water or acid soluble chromates or dichromates can be employed, especially potassium or sodium dichromate, or sodium, potassium, or lithium chromate.

Improving the corrosion resistance of metal surfaces autodeposition coated with resins has also been proposed in U.S. Pat. No. 4,186,226, which discloses using alkali metal chromates or dichromates in a post-bath rinse.

U.S. Pat. No. 3,647,567 discloses what appear to be autodeposited resin coatings which are subjected to a post-bath rinse using chromium trioxide, phosphoric acid, or water soluble or acid soluble chromates and dichromates. The specifically disclosed chromates or dichromates are: potassium, sodium, ammonium, calcium, cesium, lithium, magnesium, zinc, etc. (sic) chromates and sodium, ammonium, lithium, etc. (sic) dichromates, zinc chromate being preferred. In the only specific disclosure of such salts, (Example 3), a zinc "chromate" containing solution was prepared by adding an excess of zinc carbonate to a 10% aqueous chromium oxide solution. In the coating bath, various resin latices are disclosed, but the activating systems are oxidizing acid systems, specifically nitric acid or sulfuric acid when the substrate contains iron, zinc, or tin. A mixture of fluoroboric acid, hydrofluoric acid, chromic anhydride and potassium ferricyanide can also be employed as the activating system.

Theoretically, it is also possible to add inorganic pigments improving the autodeposition coating anticorrosive property directly into the coating bath and deposit same along with the organic resin layer on the metal surface. Known anticorrosive pigments include compounds of barium, strontium, zinc and lead, the chromates of said metals being preferably used. Such chromates without exception are only sparingly soluble in water. As is known from numerous printed publications, the autodeposition method is such that the acidic latex superficially mordants the metal surface to be coated, thereby dissolving metal ions of the metal surface into the solution. Such positive charge carriers cause the stabilized resin dispersion to coagulate in the proximity of the metal surface, whereby a homogeneous coating with the organic resin is effected without electricity. Due to the low pH of this coating process (between 1.5 and 4.0) such anticorrosive pigments are more or less rapidly converted into a soluble form, and theoretically should then be deposited simultaneously with the organic resin particles. However, the metal cations present in the acidic aqueous solutions contribute to an increased coagulation of the resin dispersion which may even result in a breakdown of the latex due to its complete coagulation.

DESCRIPTION OF THE INVENTION

The present invention provides a process for introducing metal salts having pigment and/or anticorrosive properties into autodeposited coating layers in which certain metal salts readily soluble in neutral aqueous media are incorporated in the deposited resin layers without simultaneously incorporating undesired alien ions in the organic coatings, by means of a post-bath rinse.

Specifically, it has been found that stable organic resin coatings on metal substrates, having excellent anticorrosive properties, can be obtained if, after the actual coating reaction and prior to drying the organic resin film, the metal surfaces are contacted with aqueous solutions of certain metal dichromates or certain metal hypophosphites, particularly when an activating system of hydrofluoric acid and ferric fluoride is employed in the autodeposition bath.

It has further been found that the corrosion resistance results obtained can be further improved, if certain water-soluble metal dihydrogenphosphates are added to such solutions.

Thus, the present invention relates to a process for improving the color and/or anticorrosive properties of autodeposited resin coatings on metal surfaces which is characterized in that: (a) the metal surfaces are mechanically and/or chemically cleaned by known procedures; (b) autodeposition coated with any optional organic resin in latex form preferably using a hydrofluoric acid/ferric fluoride activator; (c) if desired, rinsed with water and; (d) contacted with an aqueous solution of from 0.5 to 10% by weight of at least one of certain readily water-soluble metal dichromates or at least one of certain metal hypophosphites and, optionally, in addition thereto at least one of certain readily water-soluble metal dihydrogenphosphates; and (e) thereafter the resin coating layer containing the anticorrosive pigments is cured by drying and/or baking at an elevated temperature in a known manner.

Metal substrates which can be better protected against corrosion by application of the process of this invention comprise iron, zinc, aluminum, or alloys thereof, especially steel, as well as non-metallic surfaces which have been coated with one of said metals or its alloys.

The organic resins to be autophoretically deposited on the metal surfaces may include a variety of resin materials in latex form as known from numerous publications. Examples of such organic coating-forming resin materials, for example, are polyethylene, polyacrylates, styrene/butadiene-copolymers, vinyl chloride/vinylidene chloride-copolymers and the like. Although virtually any autodepositable resin can be used in this invention, those which produce relatively soft coatings, such as acrylic and styrene-butadiene polymers are most improved in their anticorrosive properties by the process of the invention. For the actual coating procedure, the polymers are autodeposited according to known methods on metal surfaces which have been chemically and/or mechanically cleaned in the conventional manner. This type of process is described in U.S. Pat. Nos. 3,791,431; 4,186,219; 4,414,350, all of which are incorporatd herein by reference, as well as in many other patents. If desired, the uncured coatings may be rinsed with water immediately after the actual coating reaction.

The water-soluble metal dichromates useful in this invention are strontium dichromate, ferric dichromate, cupric dichromate, and cadmium dichromate. Among these, strontium dichromate and cadmium dichromate are preferred. When hydrofluoric acid or acetic acid and an oxidizer (especially hydrofluoric acid and a ferric or other metal fluoride) is used as the activator system in the autodeposition bath, calcium dichromate and zinc dichromate are also useful, calcium dichromate being preferred.

The dichromate solutions used in the process of the present invention are obtained in any known manner, especially in accordance with the method of J. Schulze, *Zeitschrift fuer anorganische Chemie* 10:148 (1895), by adding to the metal hydroxides or carbonates, respectively, an aqueous $CrO_3$ solution in a molar ratio of 1:2, whereby the respective metal hydroxides or carbonates are dissolved, and directly applying the thus obtained aqueous dichromate solutions of these metals.

The aqueous solutions of metal hypophosphites useful in this invention are barium hypophosphite, manganese hypophosphite, nickel hypophosphite, zinc hypophosphite and/or cadmium hypophosphite. Nickel and/or barium hypophosphites are preferred.

The hypophosphite solutions are prepared by reacting the respective water-soluble metal hydroxides or sulfates with an aqueous solution of $Ba(H_2PO_2)_2.x\ H_2O$, alternatively, slurries of the respective metal hydroxides may be directly reacted with hypophosphorous acid in a molar ratio of 1:1 to form directly employable hypophosphite hydrates.

The contacting of the metal substrates coated with an uncured organic resin (after optionally rinsing with water) with the aqueous metal dichromate or metal hypophosphite solutions may be effected by: (a) immersing the metal substrate in the solutions; (b) spraying the respective solutions onto the metal substrate; or (c) by a combined immersion/spray process. The solutions have a metal dichromate or metal hypophosphite content of at least enough effectively to improve the cured resins anticorrosive properties and/or to impart the color of the pigment, preferably from 0.5 to 10% by weight. Solutions having a content of from 2 to 6% by weight are more preferably used. During the treatment of the metal surfaces with the respective solutions, an anticorrosive pigment in the form of the respective metal chromate or metal phosphate is included within the autodeposited uncured resin. Then the resin is subjected to curing in a known manner. In the course of the cure a homogeneous organic layer containing the incorporated pigments is formed.

The anticorrosive property achieved by the addition of the disclosed pigments can be still further improved by adding at least one water-soluble metal dihydrogenphosphate to the pigement solutions. Dihydrogenphosphates of the metals calcium, strontium, barium, manganese, iron, copper, zinc, cadmium or lead are preferred. The hydrogenphosphates are dissolved in the pigment solutions in an amount of 0 to 10%, preferably 0.5 to 10%, most preferably 2 to 6% by weight based on the total weight of the rinse solution.

The metal substrates rinsed with the described pigment/anticorrosive solutions are substantially better protected against corrosion in comparison to those metal substrates whose autodeposited organic resin layer was rinsed with a chromic acid solution according to the prior art. In comparative corrosion tests it has suprisingly been found that, independently of the employed organic polymer, a significant improvement of the corrosion resistance was determined even after a long-term salt spray test. Another advantage of the process according to this invention is that when the specified dichromates or hypophosphites are used no alien ions are introduced into the coating bath and the danger of a breakdown of the dispersion caused by an excessively high concentration of positive charge carriers is excluded.

The invention is further illustrated by the following non-limiting examples.

EXAMPLE 1—Preparation of the Dichromate Solutions

The respective metal hydroxides or carbonates were employed as the starting materials for the preparation of the various metal dichromate solutions. Metals which were not in the form of the hydroxide or carbonate were converted into their hydroxides.

A 20 to 40% aqueous $CrO_3$ solution was added to a 10 to 20% aqueous slurry of the metal hydroxide or carbonate, the mol ration being 1:2. After a reaction time of 10 to 30 minutes, red to dark brown clear solutions had been formed. The metal dichromates were not isolated from their solutions.

Individual Example 11.1 g (0.15 mol) of $Ca(OH)_2$ were mixed with 50 ml of $H_2O$ to form a slurry. To this slurry 30 g (0.3 mol) of $CrO_3$ in 50 ml of $H_2O$ were added in portions. After a reaction period of 15 minutes a dark orange solution had been formed which contained 18.6% $CrO_3$.

In the same manner aqueous solutions of the following dichromates were prepared: $SrCr_2O_7$; $Fe_2(Cr_2O_7)_3$; $CuCr_2O_7$; $ZnCr_2O_7$; and $CdCr_2O_7$.

EXAMPLE 2—Inventive Process Dichromates and First Resin

A polymer emulsion was prepared in accordance with Example 1 of U.S. Pat. No. 4,313,861, which emulsion contained 37.5% styrene, 55% butylacrylate, and 7.5% methacrylic acid, and had a solids content of 43%, a Brookfield viscosity (25° C.) of about 0.05 Pa.s (50 cP) and a pH of 2.2. The polymer emulsion was applied onto steel surfaces in accordance with Example 5 of the same U.S. patent, exposed to air for 1 to 2 minutes dwell and subsequently washed with water. Then the thus coated steel surfaces were rinsed with the following aqueous solutions:

2(a) strontium dichromate solution (2% $CrO_3$)
2(b) cadmium dichromate solution (2% $CrO_3$) and
2(c) calcium dichromate solution (2% $CrO_3$)
As the control there was used a
2(d) chromic acid solution (2% $CrO_3$).

Then the steel surfaces were heated and maintained at 160° C. for 15 minutes, to effect curing.

The quality of the protection from corrosion was determined in accordance with ASTM D-1654-74. The metal surfaces were cross-scratched and subjected to a salt spray test for 500 hours. Thereafter, the degree of the corrosion was evaluated by a rating from 0 to 10, 10 denoting the absence of any corrosion.

The following results were obtained for the metal surfaces treated with the above solutions.

TABLE 1

| Solution | Anticorrosion Rating (Scribe) | (Field) |
|---|---|---|
| 2a | 9 | 10 |
| 2b | 8 | 10 |
| 2c | 7 | 10 |
| 2d (Comparison) | 5 | 10 |

The instant Example clearly shows that metal substrates coated with a resin and rinsed with aqueous dichromate solutions are better protected against corrosion than those rinsed only with chromic acid in accordance with U.S. Pat. No. 4,313,861.

EXAMPLE 3—Inventive Process—Dichromates and Second Resin

A polymer emulsion was prepared in accordance with example 4 of U.S. Pat. No. 4,313,861, which emulsion contained 37% acrylonitrile, 58% butylacrylate and 5% methacrylic acid and had a solids content of 41.6%, a Brookfield viscosity (25° C.) of about 0.015 Pa.s (15 cP) and a pH of 4.1. Steel sheets were coated with this emulsion in the same manner as in Example 2, treated with the solutions and the comparative solution, respectively, as in Example 2, subjected to the salt spray test (500 hours) and rated on the same basis as Example 2. The results are set forth in Table 2.

TABLE 2

| Solution | Anticorrosion Rating (Scribe) | (Field) |
|---|---|---|
| 3a | 10 | 10 |
| 3b | 10 | 10 |
| 3c | 9 | 10 |
| 3d (Comparison) | 7 | 10 |

The above indicates that even with a different resin, a dichromate rinse according to this invention is superior to a chromic acid rinse according to U.S. Pat. No. 4,313,861.

EXAMPLE 4—Hypophosphite Preparation

For the preparation of aqueous solutions containing metal hypophosphites either the respective metal hydroxides as starting compounds were reacted with hypophosphorous acid to form the hypophosphites, or water-soluble metal sulfates were converted using the readily preparable $Ba(H_2PO_2)_2.x\ H_2O$ into the corresponding metal hypophosphites. The obtained metal hypophosphites were not isolated from their solutions. For preparing metal hypophosphites from the corresponding hydroxides, to a 10 to 20% aqueous slurry of a metal hydroxide, hypophosphorous acid was added, the mol ration being 1:2. Thus, 63.1 g (0.2 mol) of $Ba(OH)_2$. 8 $H_2O$ in 150 ml of $H_2O$ were mixed to form a slurry, and 52.8 g (0.4 mol) of a 50% aqueous $H_3PO_2$ solution was added thereto. After a reaction period of some minutes the solution became clear and contained 9.93% $H_3PO_2$ as salt.

The hypophosphite hydrates of manganese, nickel and cadmium were prepared from the corresponding water-soluble sulfates. To this purpose, to one half of the barium hypophosphite hydrate there were added 28.09 g of $NiSO_4$. 7 $H_2O$ in 100 ml of $H_2O$ in small portions. The precipitated $BaSO_4$ was separated off in a beaker centrifuge. The clear solution contained 5.55% of $H_3PO_2$ as salt.

The hypophosphite hydrates of manganese, zinc and cadmium were prepared in the same manner.

EXAMPLE 5—Inventive Process—Hypophosphites and Third Resin

A vinylidene chloride-based polymer emulsion was prepared which contained 85% by weight vinylidene chloride, 1.5% by weight acrylic acid, 8.5% by weight butylacrylate and 5% by weight acrylonitrile. Using this emulsion metal surfaces were coated in accordance with Example 5 of U.S. Pat. No. 4,313,861 and after-treated as described therein. Instead of a reaction-rinsing chromic acid, the following pigment solutions were used for the reaction-rinsing:

5(a) nickel hypophosphite solution (2% $H_3PO_2$)
5(b) barium hypophosphite solution (2% $H_3PO_2$)
5(c) cadmium hypophosphite solution (2% $H_3PO_2$) and
5(d) manganese hypophosphite solution (2% $H_3PO_2$).

For comparison an after-rinsing was carried out with 5(e) distilled water.

After baking the polymer films containing anticorrosive pigments at 100° C. for 30 minutes, the sheets were scratched according to ASTM 117-73 and subjected to a salt spray test for 500 hours. The rating in accordance with the criteria as set forth in Example 2 resulted in the values as set forth in Table 3.

TABLE 3

| Solution | Anticorrosion Rating (Scribe) | (Field) |
|---|---|---|
| 5a | 9 | 10 |
| 5b | 8 | 10 |
| 5c | 7 | 10 |
| 5d | 7 | 9 |
| 5e (Comparison) | 6 | 9 |

The metal surfaces rinsed with aqueous hypophosphite solutions apparently show better values of corrosion resistance than the metal surfaces having only been rinsed with water.

EXAMPLE 6—Inventive Process—Dichromates and Fourth Resin

A vinylidene chloride-based polymer emulsion was prepared which contained 80% by weight vinylidene chloride, 1.5% by weight acrylic acid, 13.5% by weight butylacrylate and 5% by weight acrylonitrile. Using this emulsion metal surfaces were coated and after-treated in accordance with Example 5. As the reaction-rinsing solutions the following aqueous solutions were used:

6(a) calcium dichromate solution (2% $CrO_3$)
6(b) cadmium dichromate solution (2% $CrO_3$)
6(c) chromic acid solution according to U.S. Pat. No. 4,313,861 (Comparison 1) and
6(d) distilled water (Comparison 2).

The polymer films treated with the above-described solutions were baked at 100° C. for 30 minutes, the resulting surfaces were scratched and subjected to a salt spray test for 500 hours. The anticorrosion rating was done in accordance with the evaluation criteria as set forth in Example 2; the anticorrosion ratings as obtained thereby are set forth in Table 4.

TABLE 4

| Solution | Anticorrosion Rating (Scribe) | (Field) |
|---|---|---|
| 6a | 10 | 10 |
| 6b | 10 | 10 |
| 6c (Comparison) | 9 | 10 |
| 6d (Comparison) | 7 | 10 |

The results show that the metal substrates autodeposition coated with still another resin and after-treated with the invention solutions 6a and 6b have a better anticorrosive rating than the metal surfaces after-rinsed in accordance with the prior art.

EXAMPLE 7—Addition of a Dihydrogenphosphate to a Dichromate

To 22.5 g of a $ZnCr_2O_7$ solution having a $CrO_3$ content of 25% (=0.05625 mol) there were added 3.9 g of $H_3PO_4$ (85%) (=0.0342 mol), 30 g of $H_2O$ and 1.31 g of $Zn(OH)_2$ (with 70% ZnO) (=0.01125 mol). After stirring for about 30 minutes a clear red solution had been formed. It was diluted with water to a $CrO_3$ content of 2% and used for immersion-rinsing according to the previous examples.

Molar ratios: $CrO_3$:$H_3PO_4$:$Zn^{++}$=5:3:3.5.

The coatings prepared using said solution were superior to the respective solutions containing only the metal dichromates (see Examples 2 and 3) in the 500 hours salt spray test and were even clearly superior to the latter in the 1,000 h salt spray test.

EXAMPLE 8—Addition of Dihydrohenphosphte to a Dichromate

To 22.5 g of a $SrCr_2O_7$ solution having a $CrO_3$ content of 18.25% (=0.05625 mol) there were added 3.9 g of phosphoric acid ($H_3PO_4$-85%) (=0.0342 mol), 30 g of $H_2O$ and 3.0 g of $Sr(OH)_2.8\ H_2O$ (=0.01125 mol). After stirring for about 30 minutes a clear red solution had been formed. It was diluted with water to a $CrO_3$ content of 2% and used for immersion-rinsing according to the previous examples.

Molar ratios: $CrO_3$:$H_3PO_4$:$Sr^{++}$=5:3:3.5.

The coatings prepared using said solution were superior to the respective solutions containing only the metal dichromates (see Examples 2 and 3) in the 500 hours salt spray test and were even clearly superior to the latter in 1,000 h salt spray test.

EXAMPLE 9—Inventive Process—Dichromate and Fifth Resin

Cold rolled steel panels (ca. 7.6 cm×ca. 10.1 cm, U.P.Q. type), were autodeposition coated with a bath containing a styrene-acrylic latex (100 g polymer solids/liter), predispersed carbon black pigment for color (214 g solids/liter), an activator system of HF and ferric fluoride (2.6% by volume), and deionized water q.s. to 1 liter. The coating process comprised cleaning the steel in a heated (71° C.) alkali cleaner solution, rinsing in tap water, and contacting with the above autodeposition bath. After coating the wet panels were rinsed in tap water, followed by a post-bath rinse with an anticorrosion enhancer, and then curing the coating layer by heating for 20 minutes at 160° C. The finished panels were scribed and subjected to Neutral Salt Spray Testing (ASTM-B117). After salt spray exposure, the panels were scraped with the scribe and corrosion failure was measured and evaluated. The results are given in Table 5, Anticorrosion Rating (Field) being as per Example 2.

The post-bath rinses tested were as follows:

9(a) a dilute cobalt napthenate emulsion and deionized water rinse at a level of approximately 47.5 g/liter of emulsion which ca. 2.85 g/liter were cobalt.

9(b) a dilute partially reduced chromic acid and deionized water rinse with a 30 g/liter total chromic acid content of which ca. 9 g/l were in a reduced state and 21 g/liter were hexavalent.

9(c) a cobalt chromate/dichromate rinse effectively afforded by mixing cobalt napthenate emulsion, partially reduced chromic acid, and deionized water, having a total chromate content of 15 g/liter of which ca. 4.5 g/liter were in a reduced state and 10.5 g/liter were hexavalent and 1.43 g/liter of cobalt derived from ca. 23.8 g/liter of cobalt napthenate.

TABLE 5

| Rinse Solution | N.S.S. Exposure (hr) | Scribe Failure (mm) | Anticorrosion Rating (Field) |
|---|---|---|---|
| 9a (Prior Art) | 168 | 9.6 | 9 |
| 9b (Prior Art) | 336 | 1.2 | 10 |
| 9c (Invention) | 336 | 0.8 | 10 |

What is claimed is:

1. A method for improving the anticorrosive properties of a resin autodeposited on a clean metal substrate comprising sequentially:

contacting said substrate with an autodeposition bath containing said resin in latex form and an autodeposition activator, until an uncured resin of desired thickness is autodeposited:

removing said uncured-resin coated substrate from said contact and post-rinsing said uncured-resin with a water or water and acid solution containing at least an anticorrosive effective amount of a composition consisting essentially of:

(a) at least one cupric, calcium, zinc, strontium, cadmium, ferric or cobalt dichromate readily water soluble salt; or (b) at least one metal hypophosphite readily water soluble salt; or (c) at least one metal dihydrogenphosphate readily water soluble salt in admixture with either (a) or (b); and curing said rinsed uncured-resin.

2. The method of claim 1 wherein said composition consists essentially of (a), present in 0.5 to 10% by weight, based on the total weight of the rinse solution.

3. The method of claim 1 wherein said composition consists essentially of (b), present in 0.5 to 10% by weight, based on the total weight of the rinse solution.

4. The method of claim 1 wherein said composition consists essentially of (a) and (c) each present in at least 0.5% by weight with a combined total of not more than 10% by weight based on the total weight of the rinse solution.

5. The method of claim 1 wherein said composition consists essentially of (b) and (c) each present in at least 0.5% by weight with a combined total of not more that 10% by weight, based on the total weight of the rinse solution.

6. The method of claim 1 wherein said uncured-resin is rinsed with deionized or tap water after said removing but prior to said post-rinsing.

7. The method of claim 1 wherein the total amount of said composition is 2 to 6% by weight, based on the total weight of the rinse solution.

8. The method of claim 1, 2, or 4 wherein (a) is at least one of cupric, strontium, cadmium or ferric dichromate.

9. The method of claim 8 wherein (a) is at least one of strontium or cadmium dichromate.

10. The method of claim 1, 2 or 4 wherein (a) is at least one of calcium or zinc dichromate and said autodeposition activator consists essentially of hydrofluoric or acetic acid and an oxidizing agent.

11. The method of claim 10 wherein (a) is calcium dichromate and said autodeposition activator consists essentially of hydrofluoric acid and a metal fluoride.

12. The method of claim 1, 3 or 5 wherein (b) is at least one of zinc, cadmium, barium, manganese or nickel hypophosphite.

13. The method of claim 1, 3 or 5 wherein (b) is at least one of barium or nickel hypophosphite.

14. The method of claim 1, 4 or 5 wherein (c) is at least one of copper, calcium, zinc, strontium, cadmium, barium, lead, manganese, or iron dihydrogenphosphate.

15. The method of claim 1 wherein said curing is effected by heating.

16. The method of claim 1 wherein said dichromates are prepared by reacting the respective metal hydroxides or carbonates with an aqueous $CrO_3$ solution.

17. The method of claim 1 wherein said hypophosphites are prepared by reacting the respective metal hydroxides with hypophosphorous acid.

18. The method of claim 1 wherein said hypophosphites are prepared by reacting the respective metal hydroxides or carbonates with an aqueous barium hypophosphite hydrate solution.

* * * * *